US005967106A

United States Patent [19]

Schulze et al.

[11] Patent Number: 5,967,106

[45] Date of Patent: Oct. 19, 1999

[54] CIRCUIT ARRANGEMENT AND METHOD FOR START REPEAT OF INTERNAL COMBUSTION ENGINES

[75] Inventors: Rolf Schulze, Vaihingen; Henning Stoecklein, Hemmingen, both of Germany

[73] Assignee: Robert Bosch GmbH, Stuttgart, Germany

[21] Appl. No.: 08/656,321

[22] PCT Filed: Nov. 29, 1994

[86] PCT No.: PCT/DE94/01407

§ 371 Date: Jun. 16, 1997

§ 102(e) Date: Jun. 16, 1997

[87] PCT Pub. No.: WO95/15436

PCT Pub. Date: Jun. 8, 1995

[30] Foreign Application Priority Data

Dec. 3, 1993 [DE] Germany ..... P 43 41 279

[51] Int. Cl.[6] ..... F02N 11/08

[52] U.S. Cl. ..... 123/179.3; 307/10.6

[58] Field of Search ..... 123/179.3, 179.2, 123/179.4; 290/38 R, 38 C; 307/10.6

[56] References Cited

U.S. PATENT DOCUMENTS 4,490,620 12/1984 Hansen ..... 290/38 R
5,349,931 9/1994 Gottlieb et al. ..... 123/179.2
5,601,058 2/1997 Dyches et al. ..... 123/179.2

FOREIGN PATENT DOCUMENTS 27 00 982 3/1984 Germany .
61-101671 5/1986 Japan .

OTHER PUBLICATIONS

Kraftfahr Technisches Taschenbuch Auflage 18 372 1976.

*Primary Examiner*—Willis R. Wolfe
*Assistant Examiner*—Arnold Castro
*Attorney, Agent, or Firm*—Michael J. Striker

[57] ABSTRACT

A circuit arrangement for starting an internal combustion engine by means of a sliding-gear starter (10) is proposed, by means of which the starting process is interrupted after a predetermined first time period in case of a meshing blockage and is repeated at the end of a further predetermined time period. The circuit arrangement is provided with a voltage detector for detecting a meshing blockage (blind switching of the starter), which senses the voltage drop at the storage battery (15) caused by the activation current of the starter motor when meshing. In the case of a missing voltage drop, the starter (10) is switched off via a switching element (20) of the start repeat device (18), and after a further time period of a timer circuit of the start repeat device (18) it is switched on again (FIG. 1).

11 Claims, 3 Drawing Sheets

CIRCUIT ARRANGEMENT AND METHOD FOR START REPEAT OF INTERNAL COMBUSTION ENGINES

BACKGROUND OF THE INVENTION

1. Field of the Invention

The invention relates to a circuit arrangement and a method for starting internal combustion engines by means of a starting repeat in case of a blockage of the meshing drive.

2. Prior Art

It is known in connection with drive units in vehicles or with stationary installations and the like, wherein starting operations cannot be clearly noticed, to provide starting devices which are equipped with a so-called start blocking relay and/or a start repeat relay (Kraftfahrtechnisches Taschenbuch [Technical Motor Vehicle Handbook], Bosch, 18th ed., page 373). The start blocking relay protects the starter, the pinion and the engine ring gear against overloads. It automatically turns off the starter device once the engine is running on its own. It dependably prevents the actuation of the starter device while the a engine is running. The start repeat relay protects the engagement relay of the starter against overloads in vehicles in which the start-up of the engine cannot be noticed, for example in connection with rear engines or engines under the floorboards, with stationary installations with remote control and with engines which are started indirectly, for example when a defined oil pressure or a defined pressure has been reached. The start repeat relay does not act in case of normal meshing of the starter pinion with the ring gear of the internal combustion engine. However, if in connection with so-called blind switching the pinion does not find the tooth gap of the ring gear, no contact with the main current is made in spite of the switched-on meshing relay. So that during extended actuation of the starter switch the meshing coil of the meshing relay is not overloaded and burned, the start repeat relay automatically interrupts the starting process and activates it again later. In known circuits this takes place with the aid of a delayed opening relay until the pinion has meshed with the ring gear and the main current contact has been made. However, a start repeat relay of this kind can only be used with types of starters whose main current coil has an additional output terminal (terminal 48) for a connecting line to a timer circuit capacitor in the start repeat relay. Refitting with the known start repeat relay of starters without this terminal is not possible.

Because this additional connecting terminal makes the starter device more expensive and makes the application more difficult, for the purpose of a start repeat the present invention attempts to detect blind switching of sliding-gear starters without the additional terminal by means of a novel circuit arrangement and a novel method.

SUMMARY OF THE INVENTION

It is an object of the present invention to provide an improved method and circuit arrangement of the above-described kind for start repeat of an internal combustion engine, which does not have the above-described disadvantages.

This object and others which will be made more apparent hereinafter are attained with an apparatus for starting an internal combustion engine by means of a sliding-gear starter, which comprises an electric starter motor having a pinion engageable with a ring gear of the internal combustion engine for starting the internal combustion engine and an engagement relay connected to the electric starter motor in order to supply the electric starter motor with electric current for engagement of the pinion of the starter motor when an exciter coil of the engagement relay is energized by turning a manually operated starter switch connected with the energizer coil.

According to the invention the method of starting the internal combustion engine comprises the steps of:

a) during a first predetermined time period after turning the starter switch, measuring a voltage drop in a voltage path from the storage battery to the electric starter motor;

b) comparing the voltage drop measured during the first predetermined time period (t1) with a predetermined voltage drop threshold to determine whether or not the voltage drop is less than and remains less than the predetermined voltage drop threshold during the first predetermined time period (t1);

c) switching the sliding-gear starter off for a further predetermined time period (t2) when the voltage drop is and remains less than the predetermined voltage drop threshold during the first predetermined time period (t1); and d) switching the sliding-gear starter on again after the further predetermined time period (t2) has ended.

According to the invention a circuit arrangement for performing the above-described method of the invention comprises a start repeat device including means for detecting a voltage drop at a terminal of the storage battery caused by supplying the electric current to the electric starter motor from the storage battery;

means for interrupting a starting process of the internal combustion engine for the predetermined further time period (t2) when the voltage drop is less than and remains less than a predetermined voltage drop threshold during the predetermined first time period (t1) after initiating the starting process, the means for interrupting the starting process including a circuit element and means for switching off the circuit element for the predetermined further time period in order to interrupt the starting process when the voltage drop is less than and remains less than the predetermined voltage drop threshold during the predetermined first time period (t1), the means for switching off the circuit element comprising a threshold value switch responsive to the means for detecting a voltage drop; and means for repeat starting after the predetermined further time period (t2) during which the starting process is interrupted has expired.

The circuit arrangement in accordance with the invention has the advantage over the known devices that the control of the start repeat function in sliding-gear starters is performed with the aid of a voltage detector which monitors the voltage path of the on-board voltage to which the starter is connected when the starter is switched on. Since in almost all cases the starter represents by far the largest consumer in the on-board network, it is possible to detect when the main current contact of this consumer is switched on by means of the voltage drop generated by it.

Because of this it is possible to omit the additional connecting terminal for the start repeat relay at the starter, which leads to cost savings both during production and storage. It is now additionally possible to refit starters without this additional terminal with a start repeat function. A further advantage lies in simplified wiring of the vehicle, since the line which up to now was required between the additional terminal and the start repeat relay can be omitted without replacement. Finally, a simplified circuit structure by means of electronic circuit elements in place of the conventional embodiment with a timer circuit capacitor and a relay, and a sturdier structure of smaller dimensions and cost savings are other advantages also resulting from this. It is finally also possible to combine such an electronic start repeat circuit with a start blocking circuit in one device. In this case a direct exchange or refitting of sliding-gear starters is even possible by means of the adaptation of the dimensions and of the connecting terminal of such a combined device. These advantages also apply to the method of start repeat of internal combustion engines in accordance with the invention.

Advantageous further developments and improvements of the characteristics of the invention are provided in various preferred embodiments of the invention. Successful starting of an internal combustion engine is assured in this way in that, in case of a voltage drop down to the threshold value of the threshold value switch detected during the first time period, the switching element of the start repeat device switches the starter off only when the manually actuated starter switch is opened. A particularly practical circuit design consists in that the switching element of the start repeat device is formed by a relay, whose switching contact switches the one potential (plus) of the storage battery to the exciter coil of the meshing relay, and whose relay coil is connected to the voltage by an electronic switch which can be controlled by the voltage detector via the timer circuit and via a start repeat limiter. A particularly adaptable and variable embodiment of the start repeat device can be realized in that the voltage detector, the threshold value switch and the timer circuit are realized by means of a microprocessor, via whose output a transistor can be controlled as an electronic switch or as a switching element of the start repeat device.

However, the process cycle of the start repeat or for successful starting of the internal combustion engine which, when a microprocessor is employed, is realized by means of appropriate software, can also be realized by means of commercially available electronic components in a hardware embodiment. In an advantageous manner, the voltage detector is a comparator operating as a threshold value switch in this case, whose one input is connected to a stabilizing reference voltage, whose other input is connected to a potential coupled with the voltage of the storage battery, and whose output triggers a flip-flop acting on the timer circuit for the time-limited disconnection of the starter. A particularly advantageous further development of the start repeat device can be achieved in that a start repeat limiter definitely switches off the meshing relay by means of the switching element of the start repeat device after a predetermined number of starting attempts without a subsequent voltage drop, wherein the start repeat limiter can only be reset by opening the manually actuated starter switch.

BRIEF DESCRIPTION OF THE DRAWING

The objects, features and advantages of the invention will now be illustrated in more detail with the aid of the following description of the preferred embodiments, with reference to the accompanying figures in which.

DESCRIPTION OF THE EXEMPLARY EMBODIMENTS

Figure 1:
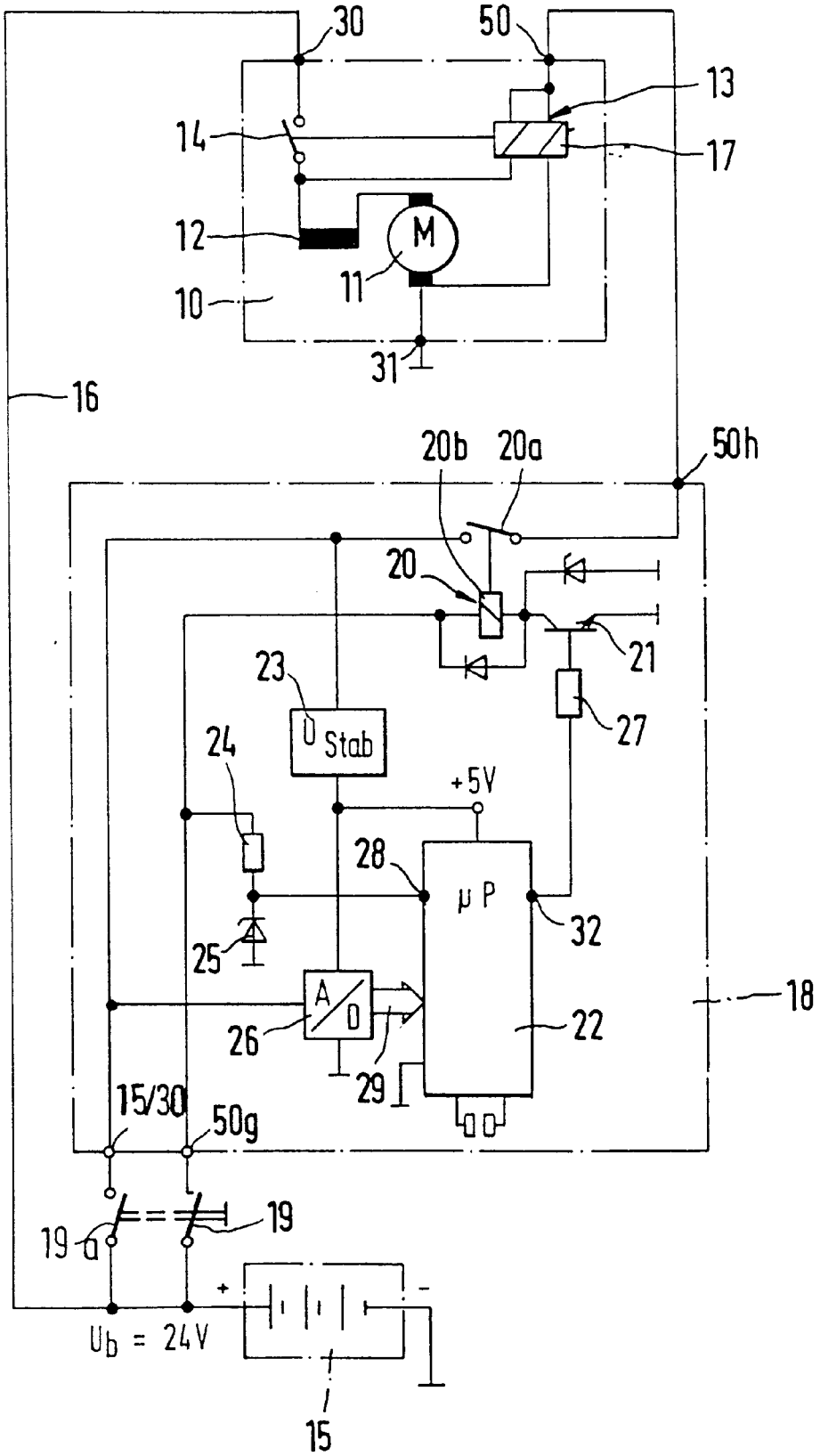
FIG. 1 is a circuit arrangement for starting internal combustion engines with a start repeat device containing a microprocessor.

A circuit arrangement for starting internal combustion engines, having a sliding-gear starter 10 of the two-stage meshing principle (engage, start), is represented in FIG. 1. The schematic representation of the sliding-gear starter 10 discloses the starter motor 11 with its main field coil 12. It furthermore comprises an engagement relay 13 for meshing of the starter pinion, not shown, with a ring gear of the internal combustion engine. By means of its relay contact 14 the engagement relay 13 also switches the starter motor 11 via a terminal 30 to the starter line 16 connected with the positive potential of a storage battery 15. Furthermore, the engagement relay 13 has an exciter coil 17 having a pull-in winding and a holding winding. In the same way as the starter motor 11, one side of the exciter coil 17 is connected via the terminal 31 to ground potential. Its connection to a terminal **50*h* of a start repeat device 18 takes place via a terminal 50. In addition, the start repeat device 18 is connected via its terminal 15/30 and via an ignition lock contact 19*a* with the positive potential of the storage battery 15, and is connected via a terminal 50*g* to a manually operated ignition-starter switch 19, whose input is also connected with the positive potential of the storage battery 15. The negative potential of the storage battery 15** is connected to ground.

The start repeat device 18 contains an electromechanical relay 20, whose switching contact **20*a* connects the positive potential from the terminal 30 via the terminal 50*h* to the exciter coil 17 of the engagement relay 13. The relay winding 20*b* of this relay 20, used as the switching element of the start repeat device, is connected on the one side to the starter switch 19 via a terminal 50*g*, and on the other side is connected to ground via an electronic switch in the form of a transistor 21. A microprocessor 22 is the main structural element of the start repeat device 18 and is supplied with a stabilized direct voltage $U_{stab}$=5 V by means of a voltage supply stage 23. When the starter switch 19 is switched on, an input 28 of the microprocessor 22 is connected via the terminal 50*g* and the resistor 24 to a signal voltage H by means of a resistor 24 and a Z-diode 25 series-connected with the ground. The positive potential of the storage battery voltage $U_b$=24 V is connected via a terminal 30 to an A/D converter 26, whose digital output signal is connected with an input port 29 of the microprocessor 22. An output 32 of the microprocessor is connected to the base of the transistor 21 via a resistor 27. In order not to overload the switching contact 20*a* of the start repeat device 18 by the current input of the engagement relay 13 at the terminal 50, it is possible in a known manner to switch a power relay into the line from the terminal 50*h* to the terminal 50, whose exciter coil is triggered by the terminal 50*h* and whose switching contact provides a connection between the starter terminals 30 and 50**.

The process cycle for a start repeat of an internal combustion engine with a start repeat device in accordance with FIG. 1 will be explained in more detail below by means of the flow diagram of FIG. 2.

First, when the ignition (switch **19*a* closes) of the internal combustion engine or the on-board voltage is switched on, the program of the microprocessor 22 is started in step 35 in that the terminal 30 is charged with a positive potential. Subsequently, in step 36, a test is performed at the input terminal 28 of the microprocessor whether the starter switch 19 was closed. As long as this is not the case, an L signal is present at the input 28 and the program stops in step 36 until the starter switch 19 is closed and as a result H potential appears at the input 28 of the microprocessor 22. Now, by means of this signal an H signal is placed on the output 32 of the microprocessor, and the transistor 21 becomes conducting. With this the exciter coil 30***b* also receives current and the relay 20 switches the relay contact 20 in step 37 on, so that the positive potential from the terminal 30 reaches the engagement relay 13 via the relay contact 20*a* and the terminal 50*h*, wherein initially the current reaches the pull-in winding of the exciter coil 17 via the terminal 50 and from there the ground. The engagement relay 13 of the sliding-gear starter 10 now advances its starter pinion, while turning at the same time, toward the ring gear of the internal combustion engine. In step 38, a time period t1 of 800 ms is spent in the microprocessor 22 simultaneously with the switching-on of the transistor 21, and during this time period the voltage potential at the terminal 30 is detected via the port 29 by means of the A/D converter 26. It is now determined in step 39 of the process cycle whether within this time t1 of 800 ms a voltage drop of Delta U=6±0.5 V was detected via the port 29. The voltage drop Delta U can be fixedly set, or it is possible in a prior program step to read the no-load voltage of the storage battery and to determine the value for Delta U by means of a characteristic curve deposited in $\mu$P22. This voltage drop occurs when, following the switching-on of the engagement relay 13, the pinion of the sliding-gear starter 10 engages the ring gear of the internal combustion engine, because of which the starter motor 11 is switched on by means of the switching contact 14 of the engagement relay 13. If this has occurred within the time t1, monitoring is performed in program step 40 to assure that the sliding-gear starter 10 remains switched on until the starter switch 19 is opened. Only now is an L signal issued in program step 41 via the output 32, and by means of it the starting process is terminated by switching off the transistor 21, the relay 20 and the engagement relay 13. The program cycle is terminated in step 42 and only with the switching-off of the internal combustion engine and the renewed switching-on of the ignition is the program cycle again initiated with the start 35.

The predetermined voltage drop Delta U is read by means of a threshold value switch, which is realized by an appropriate flag in the microprocessor 22. If in the course of the predetermined time t1 this flag was not set to 1 in program step 39, i.e. the voltage drop Delta U and thus the engagement of the sliding-gear starter 10 did not take place, the engagement relay 13 is switched off in program step 43 via the relay 20 of the start repeat device 18 in that the transistor 21 is blocked by means of an L signal at the output 32. Subsequently, in program step 44, the relay 20 is kept disconnected by means of the transistor 21 via the output 32 of the microprocessor 22 over a further predetermined period of time t2=800 ms. Afterwards the program again jumps back to program step 37 via the branch 45 and again turns the starter 10 on for another starting attempt. In accordance with an advantageous expansion of the program, shown by dashed lines in FIG. 2, it is possible instead of this to interrogate in program step 46 the state of a start repeat limiter in the form of a flag in the microprocessor 22 which, in the case of the example, has been set to three automatic start repetitions. If in step 46 the value x=3 set there has not been attained, the counter of the start repeat limiter is increased by one (x+1) in step 47, and after that the program jumps back to step 37 for repeating the start. If finally in step 46 it is determined that three repetitions of starting had already been performed, the start repetition is definitely switched off in step 42. A further starting attempt can only take place by first switching the ignition off and switching it on again. Alternatively to this the program of the microprocessor 22 can also embodied such that the start 35 takes place only by means of an H signal at the input 28 of $\mu$P22, i.e. only with switching on the starter switch 19.

In place of the fixed voltage drop of 6±0.5 V herein described, a variable voltage limit can also advantageously be used, whose value depends on the no-load voltage of the storage battery (corresponding to the on-board voltage in step 35). This variable voltage limit has already been realized in the exemplary embodiment of FIG. 3.

Figure 2:
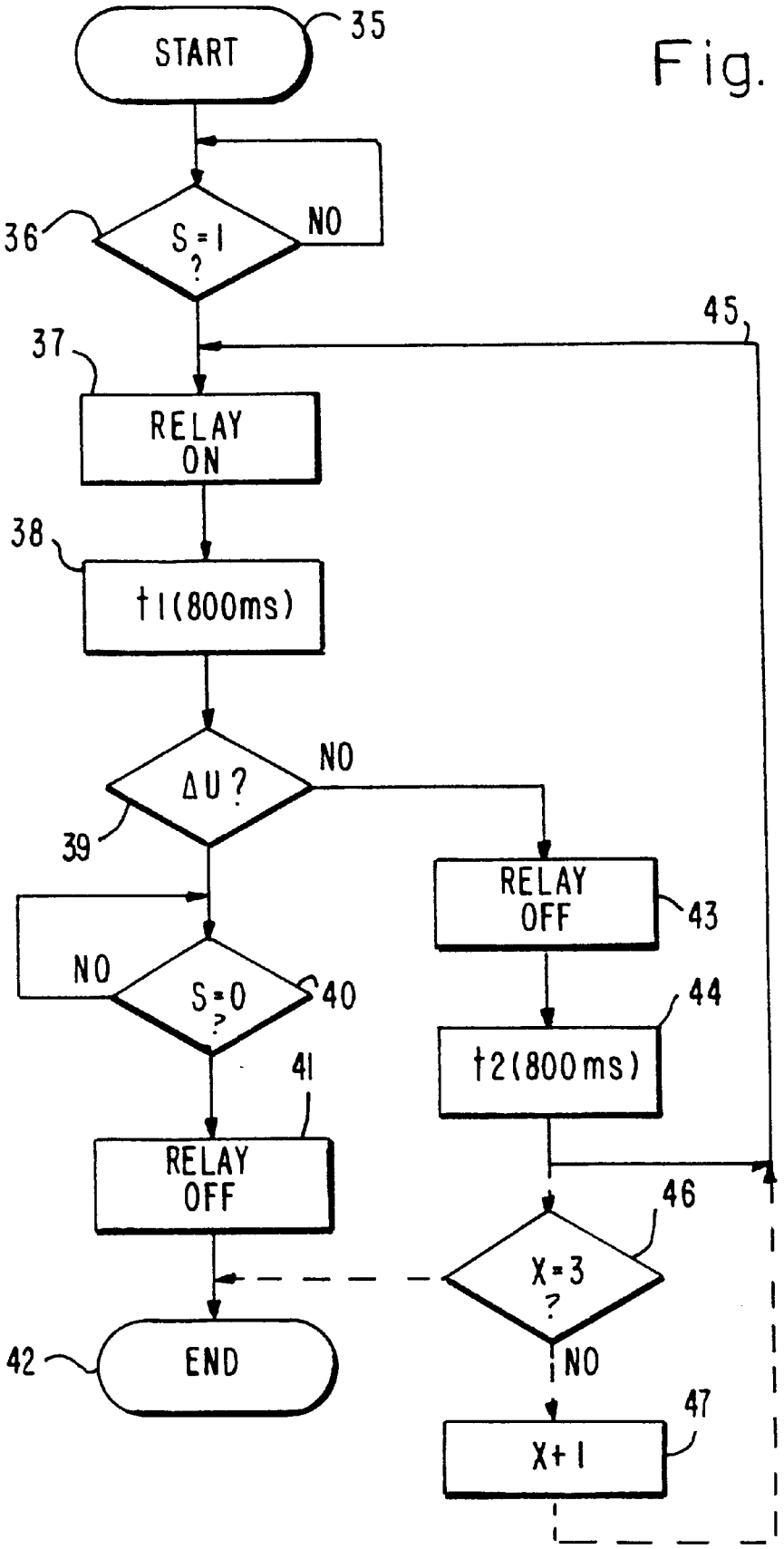
FIG. 2 is a flowchart of the method according to the invention of operation of the circuit arrangement with the start repeat device of FIG. 1.
Figure 3:
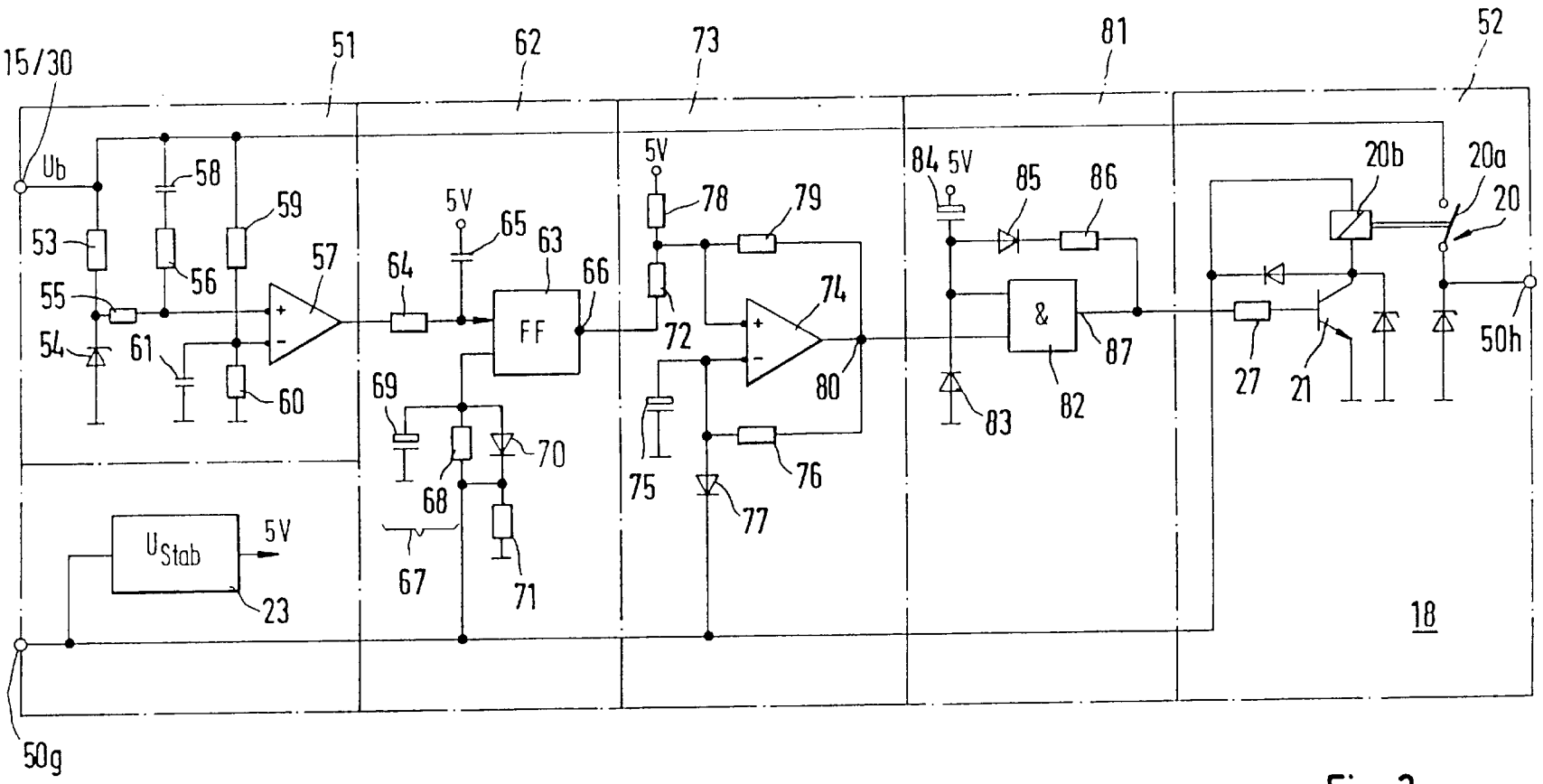
FIG. 3 shows a start repeat device for executing the process cycle in accordance with FIG. 2 embodied as a hardware circuit with electronic components.

FIG. 3 shows a start repeat device 18 with a discretely constructed circuit of electronic elements in the form of a hardware circuit as a further exemplary embodiment, wherein the circuit elements and terminals already known from FIG. 1 are provided with the same reference numerals. The positive potential of the terminal 15/30 is first looped through a voltage detector 51 and from there reaches a relay end stage 52 with the relay 20, which switches the output terminal 50*h*, and the transistor 21, which switches the relay. At its input the voltage detector 51 first has a voltage divider consisting of a resistor 53 and a Z-diode 54, whose Z-potential of 5.6 V reaches the positive input of a comparator 57 operating as a threshold value switch via a resistor 55. Furthermore, the potential of the terminal 15/30 is connected via a capacitor 58 and a resistor 56 to the positive input of the comparator 57. The negative input of the comparator is connected via a fixedly set voltage divider, consisting of the resistors 59 and 60, to the positive potential of the terminal 15/30, wherein the resistor 60, which is connected to ground, is connected parallel with a capacitor 61 for stabilizing the potential. The negative input of the comparator 57 thus is connected to a stabilizing reference voltage which is a function of the no-load voltage of the respectively connected storage battery, and the positive input is coupled via the capacitor 58 with the positive potential of the storage battery 15. The output of the voltage detector 51 controls a trigger stage 62, which essentially contains a flip-flop 63 as an information memory for a voltage drop. The output of the comparator 57 is connected via a resistor 64 to the control input of the flip-flop 63, wherein the latter, when the start repeat device 18 is turned on, causes a defined L signal at its inverse output 66 by means of a capacitor 65 via the terminal 50*g* and the stage 23. It is furthermore assured via a delay circuit 67 connected to the input of the flip-flop 63 and having a resistor 68, a capacitor 69 connected to ground, a discharge cathode 70 connected parallel with the resistor 67 and a further resistor 71 connected to ground, that the supply voltage of the voltage supply stage 23 is present before the voltage reaching the input of the flip-flop 63 from the terminal 50*g* via the delay circuit 67. The inverse output 66 of the flip-flop 63 is connected via a resistor 72 with an input of a timer circuit 73, which is designed as an astable multivibrator which is shut off via the flip-flop 63 by the output signal of the voltage detector 51 in case of a voltage drop at the terminal 30. The astable multivibrator of the timer circuit 73 consists of a further comparator 74, whose negative input is connected with a charge and discharge circuit of a timer circuit capacitor 75 connected to ground. A resistor 76, which connects the negative input of the comparator 74 with its input, is used as the charge and discharge circuit, as well as a diode 77 which connects the negative input with the terminal 50*g* in the conducting direction. The positive input of the comparator 74 is connected with the output of the flip-flop 63 via the resistor 72 and is also connected via a further resistor 78 to the supply voltage of the stage 23, and via a further resistor 79 to the comparator output 80. The comparator output 80 is connected with the input of a start repeat limiter 81 and is there connected with the input of an AND gate 82 with Schmitt trigger properties. The other input of the AND gate 82 is connected to ground via a diode 83 connected in the non-conducting direction, and is connected to the supply voltage of the stage 23 via a charging capacitor 84. It is furthermore coupled via a diode 85 and a downstream-connected resistor 86 with the gate output 87. Finally, via the resistor 27 this gate output 87 controls the transistor 21 of the relay end stage 52, whose relay 20, as described in connection with FIG. 1, switches the sliding-gear starter 10 on and off via the switching contact 20*a* in the manner provided in accordance with the flow diagram of FIG. 2.

The function of this start repeat device 18 will be explained in detail below.

With the storage battery 15 connected, a direct voltage Ub of 24 V exists at the terminal 15/30 of the start repeat device 18. Since, with the starter switch 19 open (FIG. 1), the comparators are not yet supplied with a supply voltage $U_{stab}$=5 V from the supply stage 23, an undefined signal is present at the output 87 of the start repeat limiter. However, the relay end stage 52 remains switched off because of the lack of voltage at the terminal 50*g*.

The on-board network voltage of 24 V appears at the terminal 50*g* only when the starter switch 19 in FIG. 1 is closed, and the circuit is now supplied with voltage via the output of the supply stage 23 connected thereto (step 36 in FIG. 2). A defined potential of 3.0 V is formed at the voltage detector 51 via the voltage divider 59, 60 at the negative output of the comparator (57.) In addition, the Z-voltage of 5.6 V is present through the voltage divider 53, 54 via the resistor 55 at the positive input of the comparator 57. Because of this, an H signal appears on its output and provides the inverse output 66 of the flip-flop 63 with an L signal. 90*k* of this potential is coupled via the network of the resistors 79, 78, 72 to the positive input of the comparator 74 of the timer circuit 73 and its output is thereby switched to an H signal. In the process, the negative input of the comparator 74 is initially kept connected to ground by the capacitor 75. Now the H signal at the output 80 of the comparator 74 reaches the one input of the AND gate 82 of the start repetition limiter 81. Its other input is also connected to H potential via the still discharged capacitor 84, so that its output also carries an H signal which initially prevents the charging of the charging capacitor 84 via the diode 85 and the resistor 86. Via the resistor 27, the H signal now reaches the base of the transistor 21, so that it is switched into a conducting state and switches on the relay 20. The sliding-gear starter 10 is now switched on via the terminal 50*h* (step 37).

The timer circuit capacitor 75 of the timer circuit 73 is designed such that it is charged via the resistor 76 and, after a time period t1 of 800 ms (step 38), reverses the comparator 74, provided the potential from the output 66 of the trigger stage 62 is not increased to 100% (H potential) at its positive input. However, such a potential increase takes only place if a voltage drop Delta U 5 V occurs at the terminal 30 (step 39) within this time period t1. Such a voltage drop, caused by the meshing of the starter in the ring gear of the internal combustion engine, is connected via the capacitor 58 and the voltage divider 55, 56 of the voltage detector 51 to the positive input of the comparator 57, so that its output changes to an L signal. Via the resistor 64, this L signal in turn reverses the trigger stage 62 at its inverse input 66 to an H signal, which is coupled via the resistor 72 with the positive input of the comparator 74. The output 80 of the latter now retains its H signal, so that the relay end stage 88 remains switched on via the AND gate 82 of the start repeat limiter 52 until the starter switch 19 is manually opened (step 40). In that case, both the supply voltage and the exciter coil 20*b* of the relay 20 are switched off via the terminal 50*g*, and the starting process is terminated with this (step 41).

However, if within the time period ti no voltage drop occurs at the terminal 15/30, the low potential remains at the positive input of the comparator 74 of the timer circuit 73, and by means of the charging of the timer circuit capacitor 75 of the timer circuit 73, the potential at the negative input of the comparator 74 has sufficiently risen after 800 ms, so that now an L signal appears at the output 80. The AND gate 82 of the start repeat limiter 81 is also reversed by means of this L signal, so that an L signal also appears at its output 87, by means of which the transistor 21 is blocked and the relay end stage 52 is switched off (step 43). The starting process is terminated with this. Simultaneously with this, the charging capacitor 84 of the start repeat limiter 81 is slowly charged with the supply voltage from the supply stage 23 via the diode 85 and the resistor 86 and the potential at the input of the AND gate 82 slowly decreases. In addition, the timer circuit capacitor 75 in the timer circuit 73 is simultaneously discharged again via the resistor 76. Because of a hysteresis preset by means of the wiring of the comparator 74, this comparator 74 is now only reversed again at the end of a further time period t2=800 ms (step 44), so that an H signal again appears at is output 80. The relay end stage 88 is again switched on and with it the starter via the terminal 50*h* (step 37).

The timer circuit 73 with its comparator 74 and the timer circuit capacitor 75 operates as an astable multivibrator with a phase time of t1=t2=800 ms, which can only be stopped in a successful starting operation by means of a voltage drop Delta U at the terminal 30 during the time period ti in that the potential at the positive input of the comparator 74 is raised via the flip-flop 63. As long as this is not the case, the starter is switched off and back on again at appropriate time intervals t1 and t2 in the rhythm of this astable multivibrator of the timer circuit 73 via the start repeat limiter 81 and the relay end stage 52. During each switched-off phase t2 the charging capacitor 84 of the start repeat limiter 81 is charged more and more. By means of an appropriate size of the charging capacitor 84 and the resistor 86 the charge is metered in such a way that it achieves a potential drop at the input of the AND gate 82 in the third start repeat process, which switches the output 87 of the comparator 83 definitely to L. Now the relay end stage 52 and thus also the sliding-gear starter 10 are definitely switched off by means of this L signal. The start repeat limiter 81 is only reset by turning off the supply voltage by means of opening the starter switch 19, in that the charging capacitor 84 is again discharged, so that a renewed starting attempt is possible only after this.

The start repeat devices represented in FIG. 1 and in FIG. 3 operate in accordance with the flow diagram in FIG. 2 which, in case of a meshing blockage of the starter pinion, interrupt the starting process after a first predetermined time period ti by means of a circuit element, either the relay end stage 52 or a high-powered semiconductor end stage, and repeat it at the end of a further time period t2.

A method for repeating the start of an internal combustion engine is therefore realized in accordance with the switching sequence or the program sequence in accordance with the flow diagram in FIG. 2, in which in a manner essential to the invention the voltage path of the storage battery 15 connected with the sliding-gear starter 10 is detected during a first predetermined time period t1 following the activation of the starter switch, and is compared with a predetermined threshold value wherein, in case of the absence of a voltage drop Delta U down to the predetermined threshold value by the end of this first time period, the starter 10 is switched off by the start repeat device 18 and is again switched on at the end of a further predetermined time period t2.

We claim:

1. An circuit arrangement for starting an internal combustion engine by means of a sliding-gear starter (10), said sliding-gear starter (10) comprising an electric starter motor (11) having a pinion engageable with a ring gear of the internal combustion engine for starting the internal combustion engine and an engagement relay (13) connected to the electric starter motor (11) in order to supply the electric starter motor (11) with electric current for engagement of the pinion of the starter motor (11) when an exciter coil (17) of the engagement relay (13) is energized by turning a manually operated starter switch (19) connected with the energizer coil (17);

wherein said arrangement comprises a start repeat device (18) and the start repeat device (18) includes means (22; 51) for detecting a voltage drop at a terminal (30) of said storage battery (15) caused by supplying the electric current to the electric starter motor (11) from the storage battery (15);

means (22,21,20) for interrupting a starting process of said internal combustion engine for a predetermined further time period (t2), when said voltage drop is less than and remains less than a predetermined voltage drop threshold during a first predetermined time period (t1) after initiating said starting process, said means for interrupting said starting process including a circuit element (20) and means (22,21) for switching off said circuit element (20) in order to interrupt the starting process for said predetermined further time period (t2) when said voltage drop is less than and remains less than said predetermined voltage drop threshold during the predetermined first time period (t1), said means (22,21) for switching off said circuit element (20) comprising a threshold value switch (22, 57) responsive to said means for detecting said voltage drop; and means for repeat starting after said predetermined further time period (t2) during which said starting process is interrupted has expired.

2. The circuit arrangement as defined in claim 1, wherein the circuit element (20) is a switching device electrically connected with the manually operated starter switch (19) so that said circuit element (20) is switched off when said manually operated starter switch (19) is opened.

3. The circuit arrangement as defined in claim 2, wherein said means for switching off said switching device includes the threshold value switch (22; 57), a timer circuit (22; 72) connected with said threshold value switch (22; 57), a start repeat limiting device (22; 81) connected to the timer circuit and an electronic switch (21) connected between the switching device and the start repeat limiting device, and wherein said switching device is a starter repeat device relay comprising a switching contact **(20*a*) through which said storage battery (15) is connected to said exciter coil (17) when said starter repeat device relay is energized, and a relay winding (20*b*) connected electrically with the electronic switch (21), whereby said relay winding (20*b*) is not energized for said predetermined further time period (t2) when said voltage drop is less than and remains less than said predetermined voltage drop threshold during said predetermined first time period (t1**).

4. The circuit arrangement as defined in claim 3, wherein the start repeat device (18) comprises a microprocessor having an output (32), said microprocessor comprising said threshold value switch, said timer circuit and said start repeat limiting device, and wherein said electronic switch (21) comprises a transistor having a base connected with said output (32).

5. The circuit arrangement as defined in claim 4, wherein the start repeat device (18) comprises an analog-to-digital converter (26) connected to said storage battery (15) and to an input of said microprocessor and said analog-to-digital converter (26) comprises means for converting a battery voltage ($U_b$) of said storage battery (15) into a digital battery voltage value for input to said microprocessor.

6. The circuit arrangement as defined in claim 3, wherein the start repeat limiting device (22, 81) includes means for switching off the engagement relay (13) via said electronic switch (21) after a predetermined number of starting attempts in which said voltage drop does not exceed said predetermined voltage drop threshold during said starting attempts and means for resetting said start repeat limiting device (22, 81) responsive to said manually actuated switch (19).

7. The circuit arrangement as defined in claim 1, wherein the threshold value switch comprises a comparator having two inputs and an output, one of said inputs being connected to a stabilizing reference voltage, another of said inputs being connected to a potential coupled with a battery voltage ($U_b$) of said storage battery (15) and said output being connected to a trigger device (62) acting on a timer circuit (73).

8. The circuit arrangement as defined in claim 7, wherein said timer circuit (73) comprises an astable multivibrator (74 to 79) connected to said means (22; 51) for detecting said voltage drop to receive an output signal from said means for detecting said voltage drop, whereby said astable multivibrator (75 to 79) is put in a blocking state when said voltage drop is not less than said predetermined voltage drop threshold.

9. The circuit arrangement as defined in claim 8, wherein said astable multivibrator comprises another comparator (74) having a negative input, a positive input and an output, said negative input is connected with a charging and discharging circuit (76,77) of a timer circuit capacitor (57), said positive input is connected with a charge voltage ($U_{stab}$) and with an output of said trigger device (62) connected with said timer circuit (73) and said output of said another comparator controls said circuit element (20) via a start repeat limiting device (22; 81), whereby said starter is switched on and off.

10. The circuit arrangement as defined in claim 9, wherein said start repeat limiting device (81) comprises an AND gate (82) having a first input, a second input and an output (87), said first input is connected with said output of said another comparator (74), said second input is connected with said charge voltage ($U_{stab}$) via a charging capacitor (84) and via a discharging diode (83) with ground and with said output (87) of said AND gate via a diode (85) and via a charging resistor (86) and said output (87) of said AND gate is connected with said circuit element (20) for control of the engagement relay (13) of the sliding-gear starter.

11. A method for starting an internal combustion engine by means of a sliding-gear starter (10), said sliding-gear starter (10) comprising an electric starter motor (11) having a pinion engageable with a ring gear of the internal combustion engine for starting the internal combustion engine and an engagement relay (13) connected to the electric starter motor (11) in order to supply the electric starter motor (11) with electric current for engagement of the pinion of the starter motor (11) when an exciter coil (17) of the engagement relay (13) is energized by turning a manually operated starter switch (19) connected with the energizer coil (17), said method comprising the steps of:

a) during a first predetermined time period (t1) after turning said starter switch (19) on, measuring a voltage drop in a voltage path from said storage battery (15) to the electric starter motor (11);

b) comparing said voltage drop measured in step a) during said first predetermined time period (t1) with a predetermined voltage drop threshold to determine whether or not said voltage drop is less than and remains less than said predetermined voltage drop threshold during said first predetermined time period (t1);

c) switching said sliding-gear starter off for a further predetermined time period (t2) when said voltage drop is and remains less than said predetermined voltage drop threshold during said first predetermined time period (t1); and d) switching said sliding-gear starter on again after said further predetermined time period (t2) has ended.

* * * * *